United States Patent [19]

Perry

[11] 4,046,313

[45] Sept. 6, 1977

[54] ICE CREAM CARTON

[75] Inventor: George S. Perry, Nashua, N.H.

[73] Assignee: Kraft, Inc., Glenview, Ill.

[21] Appl. No.: 655,231

[22] Filed: Feb. 4, 1976

[51] Int. Cl.[2] ..... B65D 5/48; B65D 5/54

[52] U.S. Cl. ..... 206/611; 206/624

[58] Field of Search ..... 229/51 TC, 51 TS

[56] References Cited

U.S. PATENT DOCUMENTS

| | | | |
|---|---|---|---|
| 3,270,946 | 9/1966 | Redpath et al. | 229/51 TC |
| 3,281,058 | 10/1966 | Buttery | 229/51 TC |
| 3,353,740 | 11/1967 | Outwater | 229/51 TC |
| 3,478,953 | 11/1969 | Forrer et al. | 229/51 TC |
| 3,603,502 | 9/1971 | Howard et al. | 229/51 TC |
| 3,731,871 | 5/1973 | Buttery et al. | 229/51 TC |
| 3,734,390 | 5/1973 | Buttery et al. | 229/51 TC |

*Primary Examiner*—Davis T. Moorhead

*Attorney, Agent, or Firm*—Fitch, Even, Tabin & Luedeka

[57] ABSTRACT

A carton and a blank for forming same include front, bottom and rear body panels, end walls, and a cover having end flaps overlying the upper portions of the end walls. The end flaps are secured to the end walls at generally centrally located areas thereon to retain the cover flaps in close proximity to the adjacent side panels and thus prevent their catching and spreading outwardly during subsequent processing or shipping of the carton. The cover remains easy to open as these centrally located areas are weakened to separate from their adjacent portions as the cover is lifted. A reclosure feature and anti-leak feature are also provided.

10 Claims, 5 Drawing Figures

ICE CREAM CARTON

This invention relates to improvements in cartons and more particularly relates to improvements in cartons for use in the packaging of comestibles, such as ice cream, ice milk, sherbet or the like.

Ice cream is commonly packed for home consumption in cartons made from a coated paperboard blank having end walls, front, bottom and rear body panels, and a cover, the cover having a depending skirt of front closure and end flaps. When the carton is filled with product, the end walls of the carton are firm against the product, and the cover end flaps initially lie flat against these end walls. In many such cartons, the cover front closure flap is provided with detachable means adhesively affixing the cover to the front wall of the carton when the product is packaged, and the cover end flaps are affixed to the carton end walls at only their front and rear corners. Affixing the cover end flaps intermediate these corners makes opening of the carton difficult and requires almost brute strength or knives or other cutting means to gain access to the interior of the package.

In some carton constructions, the cover end flaps are affixed only at their front and rear corners and this presents a drawback in that these flaps tend to catch on parts of adjacent cartons or other objects after the packaging of the product and before the consumer has opened the package. As a result, the end flaps often are pulled away from the end walls or are otherwise appreciably deformed or damaged by the time the package reaches the consumer.

It is therefore an object of this invention to provide an improved carton construction suitable for use in packing ice cream, ice milk, sherbet or the like, that affords easy opening while securing the cover end flaps to the carton end walls.

It is another object of this invention to provide such an improved carbon construction that is repeatedly easily and quickly reclosable.

It is yet another object of the present invention to provide such an improved carton construction that provides barriers to leakage and seepage at the corners of the completed package.

The accomplishment of these and other objects of the invention will become apparent from the following description and its accompanying drawings, of which:

Figure 1:
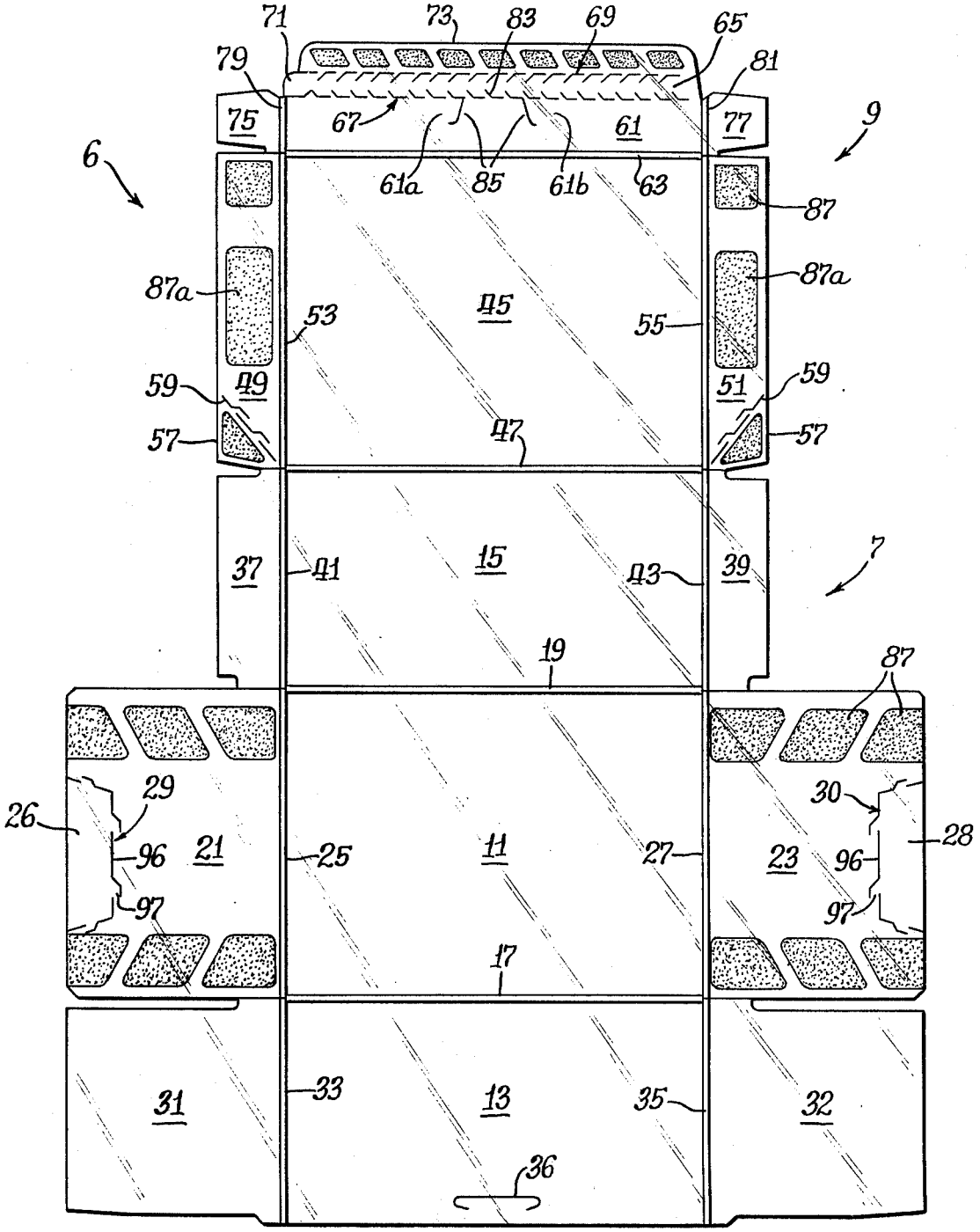
FIG. 1 is a plan view of the inner surface of a paperboard carton blank formed in accordance with this invention.

In accordance with a preferred embodiment of this invention, a carton is constructed of a paperboard blank that provides front, bottom and rear body panels, end walls in the form of inner and outer end flaps, and a cover having end flaps overlying the upper portions of the end walls. The closure flaps have their central overlapped portions retained from separation from central overlapped portions of the end walls by means such as adhesive, and to provide an easy opening feature, one of these centrally located, overlapped portions is in the form of a removable section which readily detaches when the carton is opened. A slot and interfitting tab provide for repeatedly opening and reclosing the carton easily and quickly. The adjacent creases forming the hinged connections between body panels and flaps are aligned to substantially reduce leakage or seepage of the contents at the corners of the carton. Such a carton is especially useful in the packaging of ice cream, ice milk, sherbet or the like.

A blank 6 (FIG. 1) of paperboard or the like from which the carton of the invention is made comprises a main body section generally indicated by the reference number 7 and a cover section generally indicated by the reference number 9. In the die cutting of this blank, the portion forming the main body section 7 is provided with a bottom body panel 11 and front and rear body panels 13 and 15, respectively. These front and rear body panels are hingedly connected along the side edges of the bottom panel 11 by crease lines 17 and 19 respectively. Along the end edges of the bottom body panel 11 are wall panels or end flaps 21 and 23 hingedly connected to the bottom panel by crease lines 25 and 27 respectively.

Along the outer edges of the end flaps 21 and 23 are removable sections 26 and 28 respectively. The removable section 26 is defined on three of its sides by a severance line 29 and on its fourth side by the outer edge of the flap 21. The removable section 26 thus defined is in the general form of a trapezoid wherein the side thereof along the outer edge is parallel to but somewhat longer than the opposing inner side. Such construction facilitates the removal of the section 26 when a force exerted in a direction toward the outer edge is applied to the section, as is further described hereinafter.

The removable section 28 is defined on three of its sides by a severance line 30 and on its fourth side by the outer edge of flap 23 and is otherwise in a trapezoidal form similar to that described in connection with the section 26, affording easy removal of the section 28.

Along the end edges of the front body panel 13 are inner flaps 31 and 32 hingedly connected thereto by crease lines 33 and 35 respectively. A reclosure slit 36 is provided in the center along the outer edge of the front body panel in the form indicated. This slit receives a reclosure mating tab described later.

Along the end edges of the rear body panel 15 are short inner flaps 37 and 39 hingedly connected thereto by crease lines 41 and 43 respectively.

The cover 9 comprises a cover panel 45 hingedly connected to the top side edge (as viewed in FIG. 1) of the rear body panel 15 by crease line 47. Along the side edges of the cover panel 45 are closure or cover end flaps 49 and 51 hingedly connected to the cover panel by crease lines 53 and 55 respectively. The cover end flaps 49 and 51 each include a rear tear-off corner 57 which is separable therefrom by a severance line 59.

Along the top edge (as viewed in FIG. 1) of the cover panel 45 is an overlapping closure flap 61 hingedly connected to the cover panel by a crease line 63. The overlapping closure flap 61 includes a tear strip 65 defined by side severance lines 67 and 69. At one end of the tear strip 65 is a tear strip tab 71. An adhesive strip 73 is at the outer end of the overlapping closure flap 61. A pair of end tabs 75 and 77 are hingedly connected along a portion of the end edges of the closure flap 61 by crease lines 79 and 81 respectively.

A reclosure mating tab 83 is provided in the overlapping closure flap 61. This tab is defined on its sides by two through-cut, spaced apart lines 85 of equal length that diverge from the inner severance line 67. The outer edge of the tab 83 is defined by the severance line 67. Thus, in the completed carton, when the tear strip 65 is removed the reclosure tab 83 is free to be inserted in the reclosure slit 36 in the front body panel 13. Flap portions 61*a* and 61*b* immediately adjacent the reclosure tab 83 assist in holding the cover in the closed position by forming a V-lock at each side when the tab is inserted in the slit of the body panel. In the erected carton, the end flaps 49 and 51 and the overlapping closure flap 61 all depend from the cover panel 45. The end tabs 75 and 77 cooperate with the end flaps 49 and 51 to form a continuous skirt portion depending from the reclosable cover.

It is typical for cartons to be coated with a barrier film when used to hold ice cream or the like. Such coating may be a wax or wax-base material or other suitable material and is interrupted in various areas so that bonding material may be used to form a seal between engaging uncoated areas that hold the erected carton in a standing, usable form. Such bonding areas are indicated in the present instance by shaded areas 87, ant it will be noted that these bonding areas are located on certain of the end flaps as well as the adhesive strip 73. In the erected carton, the bonding areas on the inner surface of these flaps come in contact with the outer surface of other flaps, and complementary coating-free areas must be provided on these opposite outer surfaces to form a suitable bond. A conventional hot-melt material may be utilized to effect such a bond. Such hot-melt is spot-deposited on the areas 87. The areas on the outer surfaces of the flaps complementary thereto (not shown) are masked in a suitable manner to be free of the applied coating or film barrier during the preparation of the blank 6.

It will be noted that crease lines 33, 25 and 41; 35, 27 and 43; 53 and 79; and 55 and 81 have an "in-line" relationship with respect to one another within their respective groupings. That is, the creases are aligned in straight lines in contrast to other prior art constructions in which these crease lines are offset from a true straight line relationship and from one another. Thus, the creases of adjacent panels that hinge the flaps are in line, and as these flaps are folded during the erection of the carton, the lower edge of the flaps abut a crease line, particularly near the corners of the carton, to provide a barrier against seepage or leaking of the contents.

Figure 2:
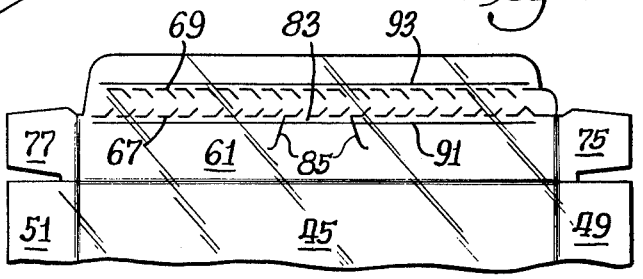
FIG. 2 is a fragmentary plan view showing the outer surface of one end of the carton blank of FIG. 1.

On the opposite or outer surface of the blank 6 on the end of the blank which includes the overlapping closure flap 61, as seen in FIG. 2, the severance lines 67 and 69 are paralleled by score lines 91 and 93 respectively that are spaced apart from their respective score lines. Each such score lines is continuous and extends substantially the entire length of the severance lines. The score lines, however, cut only the outside surface of the closure flap and do not cut completely through the flap. As a result of the cut core structure, when the tear strip is grasped and removed, any abnormal tearing stops at the cut score line and does not continue therebeyond. Consequently, defacing of the outer surface, which may contain printing and artwork, of the closure flap and cover panel is prevented.

After the blank 6 is cut and scored as indicated in FIG. 1 and a coating is applied, like blanks are accumulated, stored in the flat condition, and then transferred in the flat condition to a point of use. A stack of such flat blanks are then fed into a carton forming apparatus which erects the the carton by folding the blank into a shell, squaring the shell, and sealing the body corners with a hot-melt adhesive. Such adhesive is desirble in the circumstance where the former is erecting the carton in a continuous moving line operation and only seconds of compression time are available for establishing the bond. The carbons are then filled with ice cream, ice milk, sherbet or the like as the cartons progress on the in-line operation. After filling, the cartons pass through a covering-closing and hot-melt sealing section after which the completed packages are moved into cold storage where they await subsequent shipping and distribution.

Figure 3:
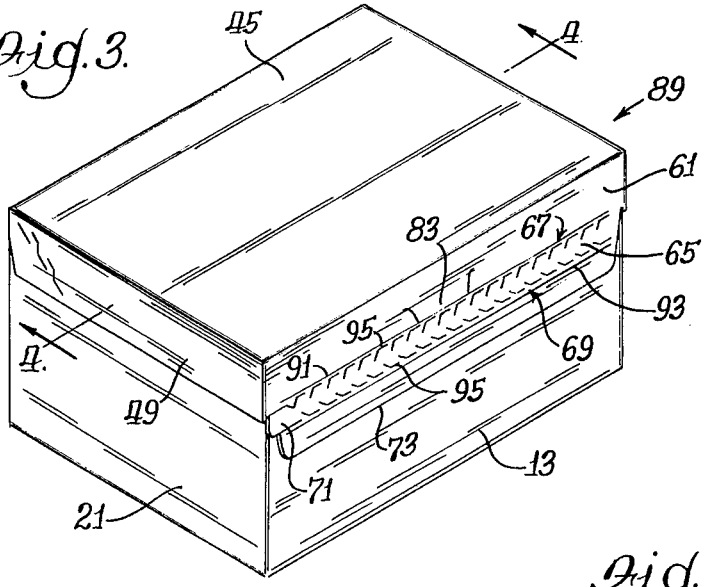
FIG. 3 is a perspective view of a completed, closed carton made from the blank of FIG. 1.

A completed, closed carton 89 is shown in FIG. 3. The cover panel 45 is held down by the adhesive strip 73 at the lower end of the closure flap 61. It can be seen that the severance lines 67 and 69 which define the tear strip 65 each comprise a plurality of discontinuous slits 95 cut substantially through the thickness of the flaps. Each slit has a portion that is collinear with the other slits and a portion that extends at an angle inwardly of the tear strip. The tab 71 at one end of the tear strip 65 is generally straight and lies in a line that is a continuation of the direction of the collinear portions of the slits. The score lines 91 and 93 are parallel to and spaced apart from these severance lines as shown.

Figure 4:
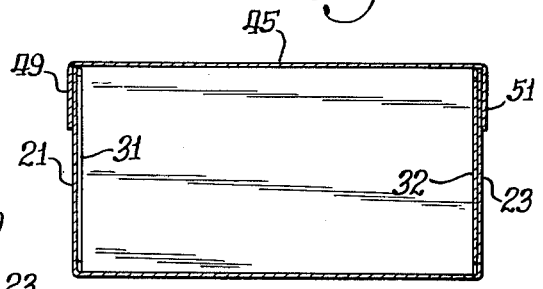
FIG. 4 is a sectional view taken along the line 4—4 of FIG. 3.

In FIG. 4, there is shown a sectional view of the carton of FIG. 3. As a result of the forming of the carton, the end walls comprise the inner flaps 31 and 32 disposed inwardly of the end flaps 21 and 23 respectively. The end flaps 49 and 51 of the depending skirt of the cover panel 45 are immediately adjacent the outer surfaces of the end flaps 21 and 23 respectively.

To open the carton shown in FIG. 3, the tab 71 is grasped and a steady pull is applied outwardly from the carton. The tear strip is thus removed from the overlapping closure flap 61 along the parallel severance lines 67 and 69. This action detaches the adhesive strip 73 from the closure flap to free the cover for opening insofar as its relation with the front body panel 13 is concerned. As the cover is then lifted, the cover end flaps 49 and 51 are separated from the rear tear-off corners 57 along the severance lines 59. These tear-off corners 57 are bonded to the outer surfaces of the end flaps 21 and 23. The tabs 75 and 77 are bonded to the end cover end flaps 49 and 51 respectively to integrate the depending skirt of the cover at the front end. Thus, the front corners of the cover end flaps are maintained flat against the front corners of the end walls of the carton without being bonded directly thereto.

In prior art cartons, where the depending cover end flaps are secured at their ends only, there has been a tendency for these cover end flaps to bow outwardly and to catch on other cartons or other objects during handling in shipping, wholesaling and retailing of the packages.

It has been proposed to join the cover end flaps to the end wall panels by adhesive along substantially the entire length thereof, but this makes the cover too difficult to remove requiring great strength or a cutting means to separate these cover end flaps from these end walls.

However, in accordance with the present invention, the cover may be easily opened while maintaining the central portions of the cover side flaps 49 and 51 secured in position against the central portions of the end wall panels 21 and 23 until the cover is opened. To these ends, centrally located portions of the cover side flaps 49 and 51 and end wall panels 21 and 23 are secured together by means, preferably an adhesive coating at adhesive areas 87*a*on the side flaps and the centrally located portions of the end wall panels including detachable and removable sections 26 and 28 as illustrated. Because the adhesive has greater strength than weakened carton material at the lines of weakening or severance lines 29 and 30, these removable sections will tear free with lifting of the hooded cover. Preferably, the removable sections 26 and 28 are on the end wall panels 21 and 23 and they remain adhesively affixed to the central portions of the closure flaps 49 and 51 as they detach from the remainder of the wall panels 21 and 23. The adhesive coatings at adhesive areas 87*a* are confined to the removable sections 26 and 28 and to control portions of the cover end flaps with the immediately adjacent areas of the cover end flaps being free of adhesive, as shown in FIG. 1. While it is possible to provide detachable removable sections in the closure flaps rather than in the end walls as illustrated herein and to provide adhesive areas in the end walls, there are disadvantages in doing so. The outside of packages containing consumer products generally are artistically printed for sales appeal to the consumer and further are imprinted and/or embossed with description, and instructions and merchandising codes. Such particularly includes the closure flaps of cartons used as contemplated herein. The procedure of imprinting and embossing may fracture the severance line of the removable section if it were located on the closure flap. Moreover, locating the removable section on the closure flap would place the severance line on the closure flap close to the flap score line if allowance is made to provide a sufficient bonding are from the flap outer edge. Because the severance line is weaker than the score line, folding of the flap along the score line could distort the flap and result in an undesirable package structure.

Figure 5:
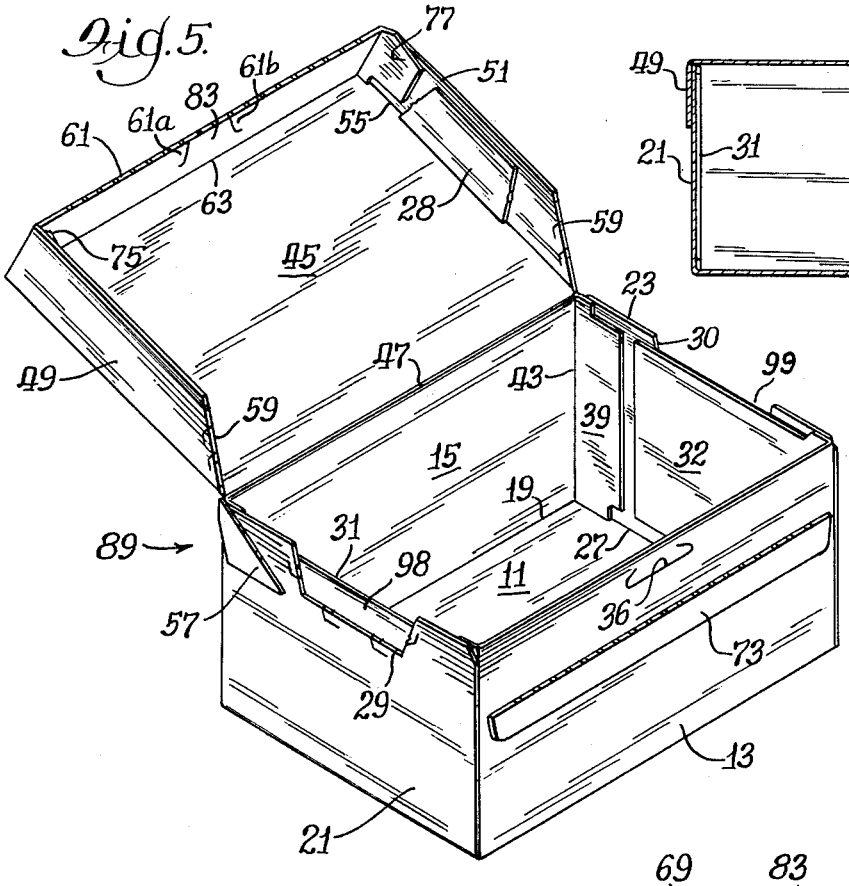
FIG. 5 is a perspective view of the carton of FIG. 3 after the carbon has been opened.

As can be seen in FIG. 5, when the cover is lifted, the removable sections are detached from the end flaps 21 and 23 and move with and as a part of the cover end flaps 49 and 51. The severance lines 29 and 30, subtantially defining the removble sections, afford a ready detachment of the removable sections from their respective end flaps while yet retaining the sections in position in the normally closed condition. As best seen in FIG. 1, each severance line includes a series of disconnected slits 97 that terminate at a slight angle to the main portion of the slit. These slits are throughcut. An uncut portion 97 intervenes the terminals of the adjacent slits. These uncut portions hold the removable sections in position normally while offering minimal resistance to detachment when an opposing force is applied. After detachment of the removable sections, the severance lines 29 and 30 define voids 98 and 99 respectively.

When the tear strip 65 is detached, it exposes the lower end of the reclosure mating tab 83. Upon reclosing of the cover, the mating tab 83 is inserted in the reclosure slit 36 in the front body panel 13, and the flap portions 61*a* and 61*b* immediately adjacent the tab assist in holding the cover in the closed position by forming a V-lock at each side of the tab after its insertion in the slit of the body panel. It is important to note that upon reclosure, the depending cover end flaps 49 and 51 extend below the severance lines 29 and 30 respectively and hide the voids 98 and 99. After the carton has been opened, the product contained in the carton is not exposed by the voids 98 and 99 because of the intervening inner flaps 31 and 32 respectively.

It will be noted that the inner end walls of the carton 89 comprise two opposed inner end flaps 31, 37 and 32, 39 that are directed toward one another but terminate in a spaced apart, non-abutting relation when the carton is erected as seen in FIG. 5. The end flaps 21 and 23 overlap these two sets of inner flaps on the outside to close the end of the carton. The inner end flaps are hinged to the end edges of the front and rear body panels, and the outer end flaps are hinged to the end edges of the bottom body panel. The inner flaps at each end of the carton are of unequal length such that their spaced apart termination, as indicated, is located between the center of the end walls and an adjacent corner of the carton, i.e., the rear corners in the illustration. The removable sections 26 and 28 are centrally located along the upper edges of the outer end flaps 21 and 23, and the longer inner flaps 31 and 32 are of sufficient length to completely intervene the removable sections, and hence the voids, and the interior of the carton. It is recognized that the end walls may take other specific forms while fulfilling these conditions, an it is not intended to limit the construction of the end walls of the carton to the precise configuration shown.

As mentioned previously, the crease lines along the side of the main body panels and cover are in line. Thus, as is seen in FIG. 5, crease line 43, for example, is in line with crease line 27 and when the short inner flap 39 is folded in position, its lower edge abuts against the crease line 27. The creases are made from the outside surface of the blank of FIG. 1, i.e., the surface opposing that shown, and result in raised portions, of the paperboard on the inner surface. These raised portions are like cushions which become slightly depressed upon engagement therewith of the lower edge of the end flaps. This engaging relationship effects barriers to leakage and seepage at the lower corners of the carton.

Accordingly, there has been provided an improved carton for use in the packaging of ice cream, ice milk, sherbet or the like that affords opening while securing the cover end flaps of the carton to its end walls, that is repeatedly easily and quickly reclosable, and that provides barriers to leakage and seepage at the corners of the erected carton.

While the invention has been described in connection with a preferred embodiment, alternatives, modifications, and variations will be apparent to those skilled in the art in view of the foregoing description. Accordingly, it is intended to embrace all such alternatives, modifications, and variations as fall within the spirit and scope of the appended claims.

What is claimed is:

1. A carton for packaging ice cream or the like comprising connected front, bottom and rear body panels; a cover panel hinged to said rear body panel; a closure flap depending from the front edge of said cover panel, an end flap depending from both end edges of said cover panel; two inner end flaps extending toward one another but terminating in spaced apart relation, said inner end flaps being hinged to the end edges of said front and rear body panels; an outer end wall panel hinged at both ends of said bottom body panel; and a removable section generally defined by a severance line and located adjacent the upper edge of each said outer end wall panel, each cover end flap overlying and being adhesively joined to the adjacent removable section and each said removable section being readily yieldable to detachment along the severance line from the outer end wall panel and remaining affixed to the cover end flap when said carton is opened.

2. A carton in accordance with claim 1 wherein said inner end flaps at each end of the carton are of unequal length such that their spaced apart termination is located between the center of the outer end wall panel and an adjacent corner of the carton; and wherein said removable section is located centrally along the upper edge of each said outer end wall panel, the longer of said inner end flaps being of sufficient length to completely intervene each said removable section and the interior of the carton.

3. A carton in accordance with claim 2 wherein the lower edges of said inner end flaps at least near the corners of the carton abut the hinged connections between said bottom body panel and said outer end flaps and form a barrier to contents leakage and seepage.

4. A carton in accordance with claim 2 wherein said closure flap includes a tear strip, an adhesive strip outwardly of said tear strip, a reclosure tab centered inwardly of said tear strip, and a reclosure slit in said front body panel, said tab being defined on its sides by two through-cut spaced apart lines of equal length and on its outer edge by the inner side of said tear strip, said tab and said slit being generally in overlying relation in the normally closed position of the carton and said slit being of a size sufficient to receive said tab upon the removal of said tear strip and subsequent reclosure of the carton, the cover being held in the closed position upon reclosure of the carton by the insertion of the tab in the slot and by flap portions immediately adjacent the tab that from a V-lock at each side of the tab when it is so inserted.

5. A blank for forming a carton for packaging ice cream or the like comprising front, bottom and rear body panels hinged together in side-by-side relation, said bottom panel intervening said front and said rear body panels, and a cover panel hinged to the side edge of the rear body panel that opposes said bottom panel; an outer end wall panel at both sides of the blank hinged to each end edge of said bottom body panel; a short inner end flap at both sides of the blank hinged to each edge of one of said front and said rear body panels; a long inner end flap at both sides of the blank hinged to each end edge of the other of said front and rear body panels; a cover end flap at both sides of the blank connected to the end edges of said cover panels; a closure flap hinged to the side edge of said cover panel that opposes said rear body panel, said closure flap including end tabs hinged to the opposed ends thereof; and a removable section defined generally by a severance line and located along the outer edge of each said outer end wall panel.

6. A blank in accordance with claim 5 wherein said removable section is located centrally along the outer edge of each said outer end wall panel and wherein said closure flap includes a tear strip defined along its sides by severance lines and located near the outer edge of said closure flap and an adhesive strip located between said tear strip and the outer edge of said closure flap.

7. A blank in accordance with claim 6 wherein the hinged connections of the flaps along the opposed end edges of said rear, bottom, and front body panels are formed by creases raised on the same face of the blank which will define the interior of the carton, said creases having an in-line relationship between adjacent panels.

8. A blank in accordance with claim 6 further comprising a reclosure tab centered in said closure flap, said tab being defined on its side by two through-cut spaced apart lines of equal length and on its outer edge by the inner severance line of said tear strip and a reclosure slit centered near the outer edge of said front body panel.

9. A container for packaging comestibles such as ice cream, or the like, comprising a main body section having front, bottom, and rear body panels and having inner and outer walls cooperating with said panels to form a box-like receptacle having an upper opening for receiving the comestible therethrough, a cover section for covering said upper opening to said body section including a top cover panel hingedly connected to said rear body panel, a pair of side closure flaps and a front closure flap each hingedly connected to said top cover panel and each depending from an edge of said top cover panel, a tear strip means on said front closure flap detachably connected to said front panel of said body section, means defining a removable section in central portions of said outer end walls, and means joining said removable sections to said side closure flaps to retain said flaps closely adjacent said outer end walls and joining the same with sufficient strength that the removable sections will readily detach and remain affixed to said side closure flaps as said cover section is pivoted upwardly from a closed position for covering the comestible to an open position for allowing access to the comestible.

10. A container in accordance with claim 9 in which said means defining a removable section includes a severance line located adjacent the upper edge of each of said outer end walls for severing said removable section from the remainder of said end wall upon opening of said cover, and said means joining said central portions comprises an adhesive coating bonding said portions with a greater adhesive strength than the force required to detach said removable sections.

* * * * *

UNITED STATES PATENT AND TRADEMARK OFFICE

CERTIFICATE OF CORRECTION

PATENT NO. : 4,046,313

DATED : September 6, 1977

INVENTOR(S) : George S. Perry

It is certified that error appears in the above-identified patent and that said Letters Patent are hereby corrected as shown below:

Col. 1, line 40, word "carbon", should be ---carton---

Col. 1, line 59, word "carbon", should be ---carton---

Col. 3, line 56, word "lines", should be ---line---

Col. 4, line 12, word "covering", should be ---cover---

Col. 5, line 5, number "87aon", should be ---87a on---

Col. 5, line 44, word "removble", should be ---removable---

Col. 5, line 49, number "97", should be ---96---

Col. 6, line 24, word "an" should be ---and---

Col. 7, line 35, word "from", should be ---form---

Col. 7, line 47, Claim 5, before word "edge", insert word ---end---

Col. 8, line 18, Claim 8, after word "strip", insert a coma ---(,)---

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*